United States Patent [19]

Smolens

[11] Patent Number: 4,791,708

[45] Date of Patent: Dec. 20, 1988

[54] ABRASION AND HYDROLYSIS RESISTANT JOINING MEANS FOR FABRIC SEAMS

[75] Inventor: H. Dana Smolens, Norristown, Pa.

[73] Assignee: Asten Group, Inc., Charleston, S.C.

[21] Appl. No.: 874,640

[22] Filed: Jun. 16, 1986

Related U.S. Application Data

[63] Continuation of Ser. No. 582,784, Feb. 23, 1984, abandoned.

[51] Int. Cl.[4] ..... F16G 3/14

[52] U.S. Cl. ..... 24/33 C; 24/33 R

[58] Field of Search ..... 24/33 C, 33 R, 33 P, 24/33 M, 418, 419

[56] References Cited

U.S. PATENT DOCUMENTS

| | | | |
|---|---|---|---|
| 340,335 | 4/1886 | Lindsay . | |
| 1,841,303 | 1/1932 | Simpson . | |
| 1,852,732 | 4/1932 | Bong . | |
| 1,948,411 | 2/1934 | Asten | 24/33 |
| 1,986,785 | 1/1935 | Argy . | |
| 2,629,909 | 3/1953 | Hall | 24/33 |
| 2,883,734 | 4/1959 | Draper, Jr. | 28/72 |
| 3,309,790 | 3/1967 | MacBean | 34/243 |
| 3,316,599 | 5/1967 | Wagner | 24/31 |
| 3,324,516 | 6/1967 | Dutt et al. | 24/33 |
| 3,335,844 | 8/1967 | Hindle et al. | 198/193 |
| 3,581,348 | 6/1971 | Lister | 24/31 |
| 3,664,907 | 5/1972 | Price | 161/89 |
| 3,751,398 | 8/1973 | Dahl | 260/47 R |
| 4,006,760 | 2/1977 | Romanski et al. | 139/383 |
| 4,026,331 | 5/1977 | Lees et al. | 139/383 |
| 4,123,022 | 10/1978 | Dutt et al. | 245/10 |
| 4,159,618 | 7/1979 | Sokaris | 57/251 |
| 4,186,262 | 1/1980 | Freeman et al. | 528/125 |
| 4,250,822 | 2/1981 | Fickers | 112/262.1 |
| 4,315,049 | 2/1982 | Fickers | 428/104 |
| 4,346,138 | 8/1982 | Lefferts | 428/222 |
| 4,359,501 | 11/1982 | DiTullio | 428/245 |
| 4,364,421 | 12/1982 | Martin | 474/255 X |
| 4,395,308 | 7/1983 | Dawes | 162/232 |
| 4,539,730 | 9/1985 | Romanski | 24/419 |

FOREIGN PATENT DOCUMENTS

| | | | |
|---|---|---|---|
| 0001879 | 5/1979 | European Pat. Off. . | |
| 2419751 | 12/1975 | Fed. Rep. of Germany . | |
| 734192 | 10/1932 | France | 24/33 C |
| 4624646 | 3/1968 | Japan | 24/33 C |
| 1383393 | 2/1975 | United Kingdom . | |
| 1387303 | 3/1975 | United Kingdom . | |
| 1388013 | 3/1975 | United Kingdom . | |

OTHER PUBLICATIONS

Research Disclosure, p. 242, dated May, 1979.

Synthesis and Properties of Polyaryletherketones, pp. 1096–1102, dated 1981, Polymer, vol. 22, Aug.

Synthesis and Properties of Polyaryletherketones, pp. 190–195, dated, 1979, ACS Polymer Preprints, vol. 20, Nov. 1, Apr.

Polyetheretherketone; Provisional Data Sheet, 3 pgs., dated Nov. 1979.

Research Disclosure No. 207, juillet 1981, Havant Hampshire (GB), "Improvements in Spiral Seams for Papermachine Felts and Fabrics", p. 264, no. 20716.

*Primary Examiner*—Victor N. Sakran

*Attorney, Agent, or Firm*—Volpe and Koenig

[57] ABSTRACT

An improved fabric seam for flat woven fabric is disclosed. The improved seam utilizes polyaryetherketones and preferably polyetheretherketones in forming the seaming elements, comprising coil elements and a joining element.

8 Claims, 2 Drawing Sheets

| PARTICULARS | BRAIDED WIRE | PEEK JOINING WIRE |
|---|---|---|
| FINISHED DIAMETER | 0.079 | 0.080 |
| RANGE | .078"- .081" | .073" - .089" |
| CORE DIAMETER | .043" | NONE |
| TOTAL BRAID THICKNESS | .036" (.018/SIDE) | - - |
| AVERAGE WEAR - T.E. | .0240" | .0096" |
| AVERAGE WEAR- L.E. | .0189" | .0089" |
| OVERALL WEAR (TOTAL) | .0429" | .0177" |
| % BRAID WEAR | 119.2 | -- |
| % OVERALL WEAR | 54.3 | 22.1 |

ABRASION AND HYDROLYSIS RESISTANT JOINING MEANS FOR FABRIC SEAMS

This is a continuation of application Ser. No. 582,784, filed Feb. 23, 1984 now abandoned.

BACKGROUND OF THE INVENTION

1. Field of the Invention

The field of the present invention is woven fabrics of synthetic yarns as may be used in papermaking and other industrial processes.

With the advent of flat woven papermakers fabrics, the need to join or seam the fabric into an endless belt became a major concern in the production of papermaker's fabrics. Many seams such as the coil seam were developed to join the fabric ends. With the increased speed, heat, and chemical deterioration associated with the use of newer papermaking equipment and higher production temperatures, the prior art coil seam materials and joining wires are proving insufficient to meet the demands of the industry.

2. Description of the Prior Art

Originally papermaking fabrics were woven endless and were placed on the machine as a single fabric without the need for seaming or any other method of joining the ends. However, over time, as the papermaking equipment grew in size and the fabrics grew in response thereto, it became desirable to weave the fabrics in what is known as a flat woven condition and to join the fabrics into an endless belt by means of seaming the fabrics. Over the years many methods have been developed to take flat woven fabrics and join them into an endless belt.

One early attempt at joining the fabrics was the use of lacing methods which entailed great work and difficulty in addition to producing seams of questionable reliability. Such a method is exemplified in U.S. Pat. No. 340,335.

Another prior art method for joining together flat woven belts in order to make them continuous is shown in U.S. Pat. No. 1,841,303. In this method a plurality of metallic elements were secured onto each end of the fabric to form a plurality of loops which were then interlaced and joined by a single pintle or hinge wire. Over the years this method was developed and refined and was frequently referred to in the industry as a clipper hook seam.

Another method for joining flat woven felts into an endless unit was through the use of a zipper or closure member. Such a method is disclosed in U.S. Pat. No. 1,852,732 and U.S. Pat. No. 1,948,411 and U.S. Pat. No. 1,986,785.

Another method of doing this is what is known in the art as the Pintle seam which is exemplified by U.S. Pat. No. 2,629,909.

Another prior art attempt to join the flat woven fabric into an endless belt was the use of interwoven formed warps which are formed and rewoven into the fabric to produce a plurality of loops through which the joining wire may be located. One example of this technique is U.S. Pat. No. 2,883,734.

Another prior art attempt at joining the belts was comprised of folded over end portions which were stitched to form loops which were interlaced and through which a flat key or joining means could be located. An example of this construction is U.S. Pat. No. 3,309,790.

Additional attempts to join the ends of fabric belts are shown in U.S. Pat. Nos. 3,316,599, 3,324,516, 3,335,844, 3,581,348, 3,664,907, 4,006,760, 4,026,331, 3,281,905, and 4,250,882.

With reference to U.S. Pat. No. 4,250,882, entitled LOW BULK PIN TYPE SEAM FOR USE IN PAPERMAKER'S EQUIPMENT FABRICS SUCH AS DRYER FELTS, the pin seam construction set forth therein is one which is compatible with the use of the joining wire and coil material in accordance with the instant invention. Additionally, U.S. Pat. No. 4,351,049, entitled STITCHLESS LOW BULK PIN TYPE SEAM FOR USE IN PAPERMAKING EQUIPMENT FABRICS, SUCH AS DRYER FELTS also sets forth a procedure which is compatible with the instant invention.

While most of the prior art constructions for joining fabric ends have proven successful as to the methodology employed, many of the fabric seams have been unsatisfactory because of the materials used in forming the seam. For instance, difficulty has been experienced with the metallic hooks used in making the fabric seam in addition to the associated problems which arise from the wear generated by the metallic members. Likewise, those seams which have attempted to employ yarns or strands actually taken from the body of the fabric and back woven thereto have met with limited success due to the stresses put on the materials. In addition, many of the prior art constructions which have employed independently constructed coils and joining wires have experienced difficulties due to the harsh environment in which the fabric must operate.

Woven fabrics fashioned into endless belts for conveying and guiding products under manufacture are used in various industrial processes. Both metallic and synthetic materials have been used for these flat woven belts as well as the seams joining the ends. As the industry and manufacturing equipment have advanced, the use of high speed and/or high temperature conditions have become more common. The more demanding conditions likewise are more destructive of the seam. Two synthetic materials which have found some use in high temperature applications are polymers known by the Trademarks Nomex and Kevlar, as reported in U.S. Pat. No. 4,159,618 and available from the Du Pont Company. These materials are twisted from multifilaments, or staple fibers into yarns, and are not available for applications where monofilament threads are preferred. Having a relatively rough, porous surface a multifilament can be difficult to keep clean in applications where contaminants are a problem. In addition to problems with contaminants, multifilaments often fail to retain their form or shape and can be difficult to join. For the foregoing reasons, Nomex and Kevlar yarns are sometimes coated with suitable resins to simulate monofilaments. These composite coated yarns can be used in fabrics where elevated temperatures are frequently encountered: however, under extended high temperature exposure, dry or moist, there can be a severe loss in tensile strength, as further reported in the above cited patent. An additional difficulty with composite yarns is that they do not withstand the physical abuse of abrasion during their operation.

Another synthetic material monofilament used with industrial conveying and guiding belts is polyester. It has gained widely accepted usage in the forming, press and dryer sections of papermaking machines because of its abrasion resistance, ability to flex, dimensional stability after being thermoset, chemical inertness, and ease of handling. Over the years techniques have been developed for weaving, thermosetting and seaming, polyester yarns and fabrics so that this material can be readily handled in the manufacture of endless belts. Polyester consequently enjoys wide acceptance; however, this material has poor high temperature hydrolytic stability, and cannot be satisfactorily used under moist conditions at continuous elevated temperatures. In papermaking applications, for example, it can be a limiting factor for the temperatures under which drying procsses can be carried out, and where high temperatures are desired some other material must be resorted to.

As can be seem from the above, the prior art has recognized that the currently available materials do not provide a seam of sufficient temperature, abrasion or hydrolysis resistance.

SUMMARY OF THE INVENTION

As a result of my investigation, I have discovered that the prior art limitations on the seam area may be overcome by the use of seaming coils and joining wires which are fabricated from monofilaments extruded from one of the family of polyaryletherketones. A preferred polyaryletherketone is polyetheretherketone or PEEK.

It is an object of my invention to provide a coil seam constructed of elements which are performed from synthetic monofilament yarns having increased temperature, abrasion and/or hydrolysis resistance.

DESCRIPTION OF THE PREFERRED EMBODIMENTS

Figure 2:
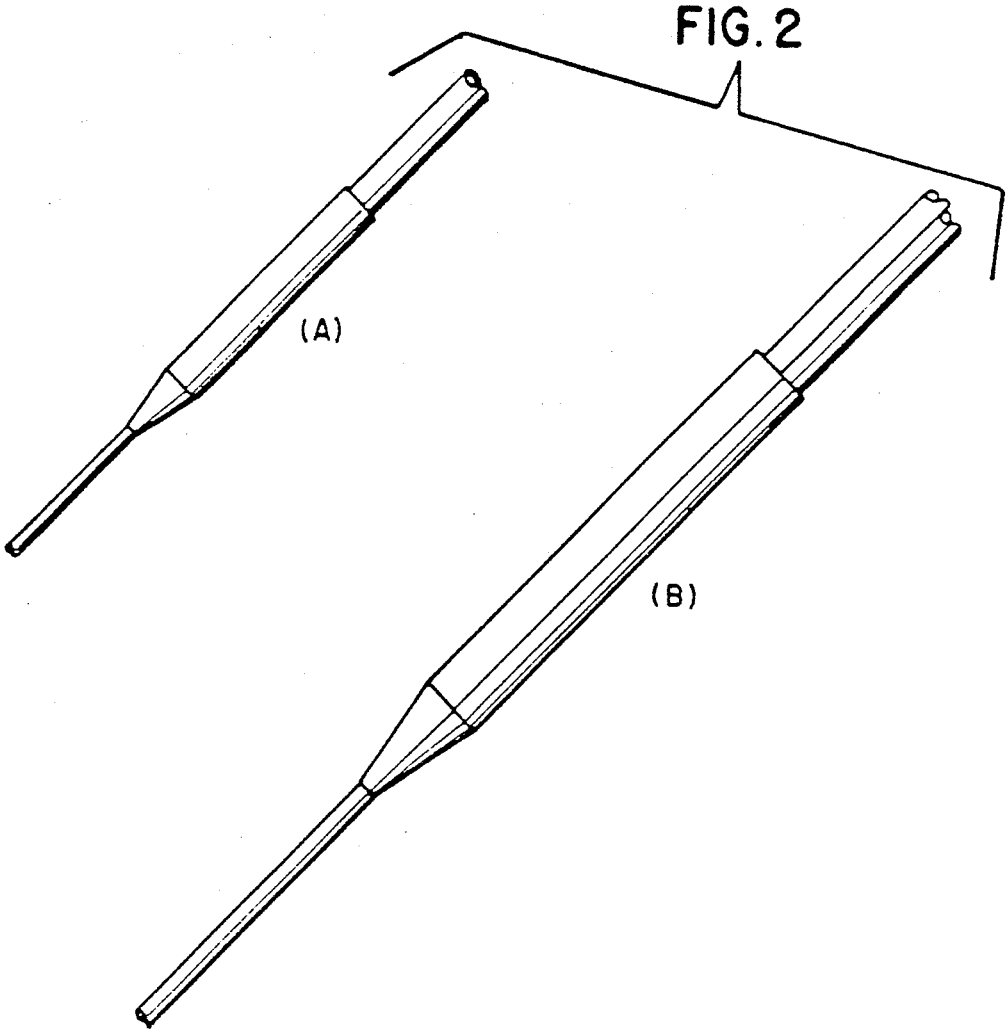
FIG. 2 depicts joining elements according to the invention; (A) is a monofilament joining element and (B) depicts an embodiment having more than a single monofilament joining wire.

All of the monofilament of the coil and joining wire as depicted in FIG. 2 were extruded monofilaments of polyetheretherketones. Seaming elements fabricated from polyaryletherketones polymers could be utilized in fabrics using various synthetic materials alone or in combination with other threads of other synthetic materials. However, due to the different weaving and heat setting characteristics of the various materials, it will be necessary to design the fabric with final finishing in mind.

Since the class of materials polyaryletherketones have higher heat characteristics, they have associated higher heat settings or thermal plastic characteristics. In addition, polyaryletherketones are generally more costly than the prior art materials used for coils and joining wires and accordingly, are most useful in those applications where the additional cost of heat setting and the raw materials are justified by the environment and the long life provided by the polyaryletherketone materials. As noted, the heat setting characteristics of the polyarlyetherketones will be somewhat different than the characteristics of the synthetic materials which make up the fabric body. As will be explained hereinafter, it is necessary to heat set the coils of the instant invention separately from those of the fabric body because of the elevated temperatures necessary for working the coil material.

The polyaryletherketone material becomes economically practical when the application calls for a high temperature, high moisture, high speed environment. Under these conditions, the added seam life combined with increased production time justify the additional cost associated with the polyaryletherketone polymers.

Polyaryletherketone polymers suitable as the monofilaments in the practice of this invention are polyetherketones having the repeating unit

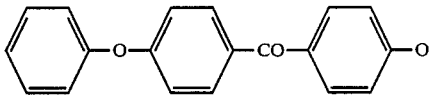

identified in the claims as —ϕ—O—ϕ—CO—ϕ—O such as polyetheretherketone prepared by nucleophilic polycondensation of bis-difluorobenzophenone and the potassium salt of hydroquinone. A detailed explanation of preparation of polyetherketones having the above identified repeat unit may be found in EPO application No. 78300314.8 filed on Aug. 22, 1978 and published on July 16, 1979.

Other polyaryletherketones polymers which appear suitable for monofilament threads in fabrics according to the invention are those having either of the following repeat units:

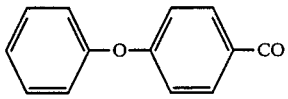

identified in the claims as —ϕ—O—ϕ—CO— -and

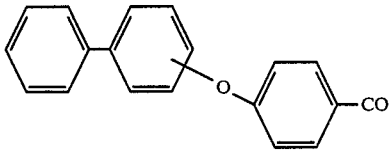

identified in the claims as —ϕ—ϕ—O—ϕ—CO— which are described in more detail in U.S. Pat. No. 3,751,398 and ICI Research Disclosure of May, 1979, No. 18127 at page 242. According to the above referenced ICI disclosure, there were problems encountered lubricant with the polyetherketone. Thus, before processing, the polyetherketone is dusted with the calcium stearate e.g. by dry tumbling. The best level of calcium stearate to use may be found by experiment but we have found 0.1–0.2% particularly about 0.15% (based on the weight of the polyetherketone) to be satisfactory. While calcium stearate is a well-known lubricant for many polymers, its successful use under the present circumstances is somewhat surprising in view of the very high processing temperatures employed; one might have expected calcium stearate to decompose or degrad at such temperatures or at any rate be rendered inactive.

Polyaryletherketone resins of the foregoing types are commercially available from several companies, including Raychem Corporation and Imperial Chemical Industries Limited. Suitable techniques for their preparation are described in Attwood et al, Synthesis and Properties of Polyaryletherketones, Polymer, Vol. 22, Aug. 1981, pp. 1096-1103; Attwood et al, Synthesis and Properties of Polyaryletherketones, ACS Polymer Preprints, Vol. 20, No. 1, April 1979, ppg. 191-194; and EPO published application S.N. 78300314.8, Thermoplastic aromatic Polyetherketones etc. See also U.S. Pat. Nos. 3,751,398 and 4,186,262 and British Pat. Nos. 1,383,393, 1,387,303 and 1,388,013. Some data with respect to extruding high temperature polyaryletherketones may be found in ICI research Disclosure of May, 1979, No. 18127 at page 242. The disclosures of the foregoing are incorporated herein by reference. Briefly, the resins may be prepared by Friedel-Crafts condensation polymerization of appropriate monomers using a suitable catalyst such as boron trifluoride. The polyaryletherketone resins suitable for the practice of this invention are to be melt extrudable, i.e. they should have appropriate molecular weights and intrinsic viscosities so as to be capable of extrusion into monofilament form.

In extruding the polyetheretherketone (PEEK) monofilaments useful in the invention, it was found that a lubricant, as previously suggested, was not necessary for proper extrusion. In extruding, the temperature profile of the several extruder zones have been heated to approximately 390° C. (734° F.) for the initial extruding, and as flow begins temperatures were reduced to 350° C. (662° F.) in the feed zone, and 380° C. (716° F.) in the transition zone and metering zone, and 370° C. (698° F.) in the die zone. Spinerettes have been used like those for other extrusions, to produce a monofilament of the desired final diameter, such as 16 mils. Various filament sizes can be obtained by adjusting screw, pump and pull roll speeds, and final thread sizing is made in a subsequent drawing operation. ICI Provisional Data Sheet of November, 1979, Ref. No. PK PD9, in providing some drawing data indicates a draw ratio of 2.8:1.

The polyaryletherketones exhibit excellent retention of tensile strength at temperatures up to at least 500° F. (260° C.). The polyetheretherketones and the polyetherketones have similar characteristics. For example, the melting point of a typical polyethertherketone of 334° C. (633° F.) compares with 365° C. (689° F.) for a typical polyetherketone, and the glass transition temperatures are respectively 143° C. (289° F.) and 165° C. (329° F.).

The polyaryletherketones also have a modulus of elasticity higher than PET polyester and a greater retention of tensile strength with increase in temperature. Such characteristics indicate good finishing qualities and these materials also exhibit adequate flexibility.

I have discovered that it is necessary to wind the PEEK coil material at lower speeds and under greater tension than that normally associated with the prior art coil materials. Likewise, the heat setting conditions and temperatures used in manufacturing the coils must be adjusted to reflect the high temperature and rigidity characteristics of the PEEK material.

Figure 1:
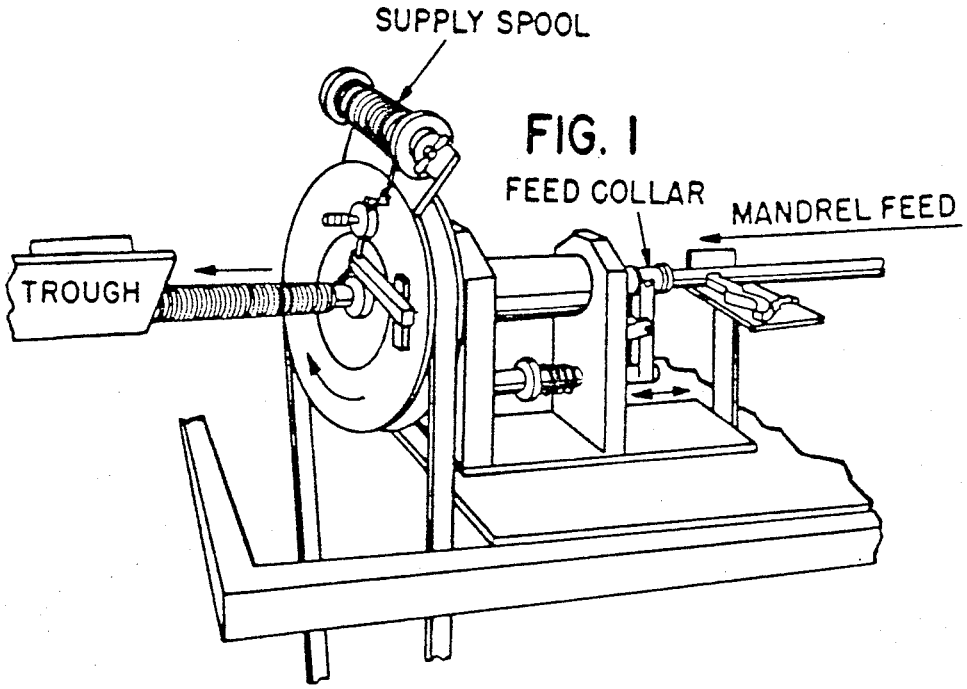
FIG. 1 depicts a coil winding apparatus suitable for producing the coils according to the invention.

With reference to FIG. 1, there is shown a suitable coil winding apparatus. The first effort to produce coil materials was with a 44 mil diameter PEEK monofilament. The coil materials were produced on a two section mandrel at 24 loops per inch for the desired distance. The length of the seam coil is a matter of design choice and does not form part of the invention. The fly wheel revolved about the mandrel at approximately 30 revolutions per minute and the mandrel advanced approximately ⅛" per revolution. The successfully wound PEEK coils, while still on the mandrel, were placed in a hot air oven and subjected to 450° F. temperature for approximately 10 minutes. The coils, see FIG. 3, were permitted to cool before being removed from the mandrels.

It will be appreciated by those skilled in the art that the maximum diameter of the monofilament may exceed 44 mils and that the fabric design will determine the maximum diameter compatible with the fabric and its end use. From the current fabric design trends, it is expected that a maximum monofilament diameter would be about 50 mils.

There were some attempts to produce PEEK monofilament coils using monofilament material having a diameter as small as 24 mils. However, due to difficulty in obtaining monofilament having sufficiently uniform diameters and as a result of the technique used with the particular test mandrel, the 24 mil monofilaments were not actually used as seaming coil materials. However, as a result of the initial work which has been done with the production of PEEK monofilament coil materials and the expected improvement in the extruding techniques, it is believed that the PEEK monofilament materials will be useful in diameters as low as 16 mils. As the technique for producing the monofilament and for producing the coils is improved, it is possible that even smaller diameter monofilament material will be useful. The limitation on the diameter is related to the technical properties of the material and its ability to resist abrasion and hydrolysis in the seam area. In addition, it will be recognized that better control of the production of the PEEK monofilament will make it possible to obtain the benefit of PEEK monofilament with even smaller diameters.

The use of PEEK material as coil material and joining wires should prove superior on papermaking machines. The PEEK monofilament has substantially better abrasion resistance and hydrolytic chemical deterioration resistance not available with prior art seaming monofilaments. Since paper machines have inherent risk of heat and chemical attack, the PEEK monofilament will improve the life cycle of the fabric seam.

With reference to FIG. 2, there is shown PEEK monofilament which has been developed into joining wires for use with the coil in making the fabric seam. It will be appreciated by those skilled in the art that the technique(s) for producing such as a joining wire, whether it be a single FIG. 2(A) or double FIG. 2(B) joining wire, is known to those skilled in the art and that the technique does not form part of the instant invention.

The end uses for these new joining wires fit well into the chemical and abrasion resistance necessary in modern papermaking equipment. The shear forces generated in the seams, which are perpendicular to the longitudinal axis, appear to have no adverse effects on the superior wear (abrasion) properties of this monofilament. It is noted that with prior art use of polyester and polyamide monofilament strands, these same forces produce adverse effect on similar sized joining wires.

Figures 3, 4:
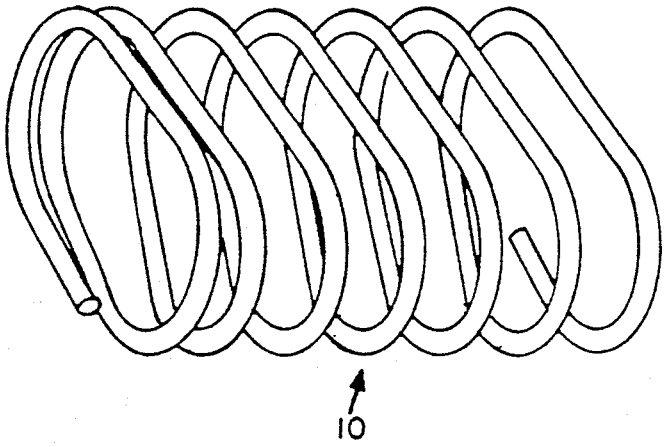
FIG. 3 depicts a coil element according to the invention prior to its application in the fabric seam.
FIG. 4 is a table depicting the results of testing conducted in connection with the invention.

With reference to FIG. 3, there is shown a single coil element according to the invention. As will be appreciated by those skilled in the art the coil element, after it has been wound on the mantle and subjected to the hot air oven heat set, will have a generally eliptical shape. The coil 10 will be continuous in length and will be sized so as to extend uninterupted for the entire width of the fabric. As will be appreciated by those skilled in the art, the coil element will be extended slightly during its application to the fabric and will become expanded so that there will be a space between each of the successive elipses of the coil element. Likewise, it will be understood by those skilled in the art that a similar element is placed on each end of the fabric to be joined. After the coil elements have been placed on each end of the fabric, the fabric ends are drawn together and the coil elements are interleafed such that one element fills the spaces between the elipses of the other element and a channel is formed for receiving the joining wire.

With reference to FIG. 4, there is shown in table form the test results of the PEEK joining wires according to the invention versus a typical braided joining wire. The tests were designed to compare a PEEK monofilament joining wire to a braided type number 16 joining wire, currently available from Asten-Hill Company of Devon, Pa., in a standard seam design. Suitable samples were obtained in sufficient quantities for the trial. The diameter of the sample varied greatly, from 0.073" to 0.089" in diameter, as compared to a desired 0.079" finished diameter; however, despite the variation in diameter, the tests were conducted in order to confirm initial observation on the improved seam elements. Sample seams were prepared and placed on a test apparatus. Samples were run at 1720 FPM at 16.0 PLI tension. The samples were run in a test chamber with a 50% relative humidity and an air temperature of about 220° F. As can be seen from FIG. 4, the results indicate that the PEEK joining wire was substantially better than the typical prior art braided joining wire. The braided type joining wire exhibited a performance level slightly lower than normally expected, however, it was within the range of typically expected performance.

As will be appreciated by those skilled in the art, the higher heat setting characteristics of the PEEK material will produce a coil or seam which is less likely to be modified by the temperatures associated with the heat setting of the remaining fabric. However, it should be understood that the PEEK material will experience some plasticity due to elevated temperatures and pressures associated with the normal heat setting process. Thus, the coil materials will be set as a result of their being wrapped on the mandrel and then will be inserted into the fabric to create the interlooping portions of the seam. The fabric will then be placed on the heat setting apparatus with the interlooped coiled ends secured by means of a joining wire. The fabric will then be subjected to the temperature and pressure necessary for the heat setting consistent with the fabric materials and end use of the fabric and will be heat set in the normal course. As a result of the increased resistance to heat setting of the PEEK coil materials versus the fabric, it will be appreciated that care must be taken in producing the coil elements so that the coil will be consistent with the weave and end use of the fabric.

I claim:

1. Means for joining the ends of a flat woven heat sensitive industrial fabric into an endless papermaker's belt, said means comprising at least two fabric connecting elements, having a heat set temperature different from the heat set temperature of the interwoven threads of said flat woven industrial fabric and greater than 400° F., and a joining element, each of said connecting elements being a preformed and heat set coil of polyetheretherketone continuous filament having a preformed and heat set final height dimension which is no greater than the maximum thickness of the final finished papermaker's belt, whereby the connecting elements are secured to the respective ends of the flat woven fabric and are intermeshed to form a passage way for receiving the joining element therethrough and establishing the endless papermaker's belt, said connecting elements being heat set and preformed prior to use as a connecting element so as to avoid damage to said fabric from heat setting.

2. The means of claim 1 wherein said connecting elements are preformed from monofilaments having an outer diameter greater than 16 mils.

3. The means of claim 1 wherein said joining element is comprised of more than one monofilament.

4. The means of claim 1 wherein each of said connecting elements is preformed from monofilament having an outer diameter no greater than about 50 mils.

5. The means of claim 4 wherein each of said connecting elements is preformed from monofilament having an outer diameter greater than about 16 mils and less than about 50 mils.

6. The means of claim 5 wherein said monofilaments have an outer diameter no greater than 44 mils.

7. The means of claim 5 wherein said joining element is comprised of more than one monofilament.

8. Means for joining the ends of a flat woven heat sensitive industrial fabric having a heat setting temperature of less than 400° F. into an endless papermaker's belt, said means comprising at least two fabric connecting elements having a heat set temperature higher than 400° F. and a joining element, each of said connecting elements being a thermoplastic continuous filament preformed and heat set to a final height dimension which is no greater than the maximum thickness of the final finished papermaker's belt, whereby the connecting elements are secured to the respective ends of the flat woven fabric and are intermeshed to form a passage way for receiving the joining element therethrough and establishing the endless papermaker's belt, said connecting elements being heat set and preformed prior to use as a connecting element so as to avoid damage to said fabric from heat setting.

* * * * *

UNITED STATES PATENT AND TRADEMARK OFFICE

CERTIFICATE OF CORRECTION

PATENT NO. : 4,791,708

DATED : December 20, 1988

INVENTOR(S) : H. Dana Smolens

It is certified that error appears in the above-identified patent and that said Letters Patent is hereby corrected as shown below:

At column 2, line 17, the word "most" should be --many--.

At column 3, line 14, the word "seem" should be --seen--.

At column 4, line 22, the word "polyetherketones" should be --polyetheretherketones--.

At column 5, line 12, the word "research" should be --Research--.

Signed and Sealed this

Twenty-fifth Day of April, 1989

*Attest:*

DONALD J. QUIGG

*Attesting Officer*

*Commissioner of Patents and Trademarks*

US004791708B1

REEXAMINATION CERTIFICATE (2467th)

United States Patent [19]

Smolens

[11] B1 4,791,708

[45] Certificate Issued Feb. 7, 1995

[54] ABRASION AND HYDROLYSIS RESISTANT JOINING MEANS FOR FABRIC SEAMS

[75] Inventor: H. Dana Smolens, Norristown, Pa.

[73] Assignee: Asten Group, Inc., Devon, Pa.

Reexamination Request:
No. 90/002,970, Feb. 25, 1993

Reexamination Certificate for:

| | |
|---|---|
| Patent No.: | **4,791,708** |
| Issued: | **Dec. 20, 1988** |
| Appl. No.: | **874,640** |
| Filed: | **Jun. 16, 1986** |

Certificate of Correction issued Apr. 25, 1989.

Related U.S. Application Data

[63] Continuation of Ser. No. 582,784, Feb. 23, 1984, abandoned.

[51] Int. Cl.[6] ..... F16G 3/00

[52] U.S. Cl. ..... 24/33 C; 24/33 R

[58] Field of Search ..... 24/33 C, 33 R, 33 P, 24/33 M

[56] References Cited

U.S. PATENT DOCUMENTS

| | | | |
|---|---|---|---|
| 4,315,049 | 2/1982 | Fickers | 428/104 |
| 4,359,501 | 11/1982 | Ditullio | 428/245 |
| 4,381,612 | 5/1983 | Shank | 34/116 |
| 4,395,308 | 7/1983 | Dawes | 162/232 |

FOREIGN PATENT DOCUMENTS 734192 10/1932 France .

OTHER PUBLICATIONS

Research Disclosure No. 20716 "Improvements in Spiral Seams for Papermachine Felts and Fabrics".

*Primary Examiner*—Victor Sakran

[57] ABSTRACT

An improved fabric seam for flat woven fabric is disclosed. The improved seam utilizes polyaryetherketones and preferably polyetheretherketones in forming the seaming elements, comprising coil elements and a joining element.

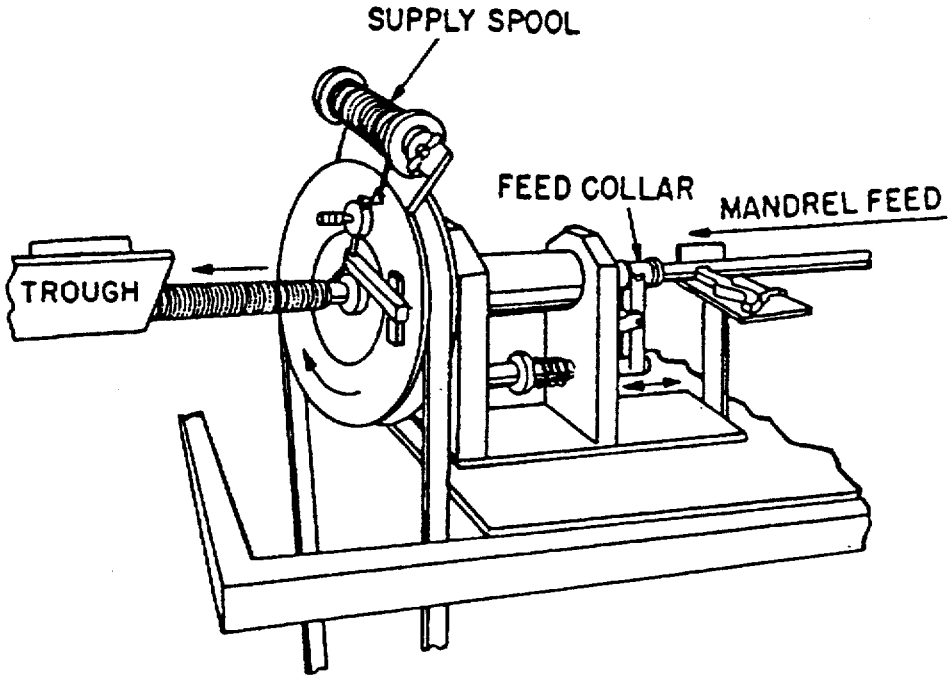

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–7 and 8 are confirmed.

* * * * *

US004791708B1

REEXAMINATION CERTIFICATE (2741th)

United States Patent [19]

Smolens

[11] B2 4,791,708

[45] Certificate Issued Nov. 28, 1995

[54] ABRASION AND HYDROLYSIS RESISTANT JOINING MEANS FOR FABRIC SEAMS

[75] Inventor: H. Dana Smolens, Norristown, Pa.

[73] Assignee: Asten Group, Inc., Devon, Pa.

Reexamination Request:
No. 90/003,706, Jan. 20, 1995

Reexamination Certificate for:

| | |
|---|---|
| Patent No.: | **4,791,708** |
| Issued: | **Dec. 20, 1988** |
| Appl. No.: | **874,640** |
| Filed: | **Jun. 16, 1986** |

Reexamination Certificate B1 4,791,708 issued Feb. 7, 1995

Certificate of Correction issued Apr. 25, 1989.

Related U.S. Application Data

[63] Continuation of Ser. No. 582,784, Feb. 23, 1984, abandoned.

[51] Int. Cl.[6] ..... F16G 3/00

[52] U.S. Cl. ..... 24/33 C; 24/33 R

[58] Field of Search ..... 24/33 C, 33 R, 24/33 M, 33 P; 139/383 AA

[56] References Cited

U.S. PATENT DOCUMENTS

| | | | |
|---|---|---|---|
| 3,436,041 | 4/1969 | Haller | 139/383 AA |
| 3,664,907 | 5/1972 | Price | 139/383 AA |
| 4,141,388 | 2/1979 | Romanski et al. | 139/383 AA |
| 4,246,747 | 1/1981 | Plunkett et al. | 57/245 |
| 4,315,049 | 2/1982 | Fickers | 428/104 |
| 4,359,501 | 11/1982 | DiTullio | 428/245 |
| 4,381,612 | 5/1983 | Shank | 34/116 |
| 4,395,308 | 7/1983 | Dawes | 162/232 |
| 4,426,795 | 1/1984 | Rudt | 139/383 A |
| 4,539,730 | 9/1985 | Romanski | 24/33 |

FOREIGN PATENT DOCUMENTS

| | | |
|---|---|---|
| 734192 | 10/1932 | France . |

OTHER PUBLICATIONS

Research Disclosure No. 207, Jul. 1981, Havant Hampshire (GB), "Improvements in Spiral Seams for Papermachine . . . ," p. 264, No. 20716.

Technical Bulletin No. 3, "DRI–FAB Fabrics," Formex Company, pp. 2–4.

Gavelin, G., Paper and Paperboard Drying: Theory and Practice, Lockwood Trade Journal Co., Inc., 1964, pp. 29 and 31.

"Textile Terms and Definitions," The Manchester Textile Institute, 1975, p. 75.

*Primary Examiner*—Victor Sakran

[57] ABSTRACT

An improved fabric seam for flat woven fabric is disclosed. The improved seam utilizes polyaryetherketones and preferably polyetheretherketones in forming the seaming elements, comprising coil elements and a joining element.

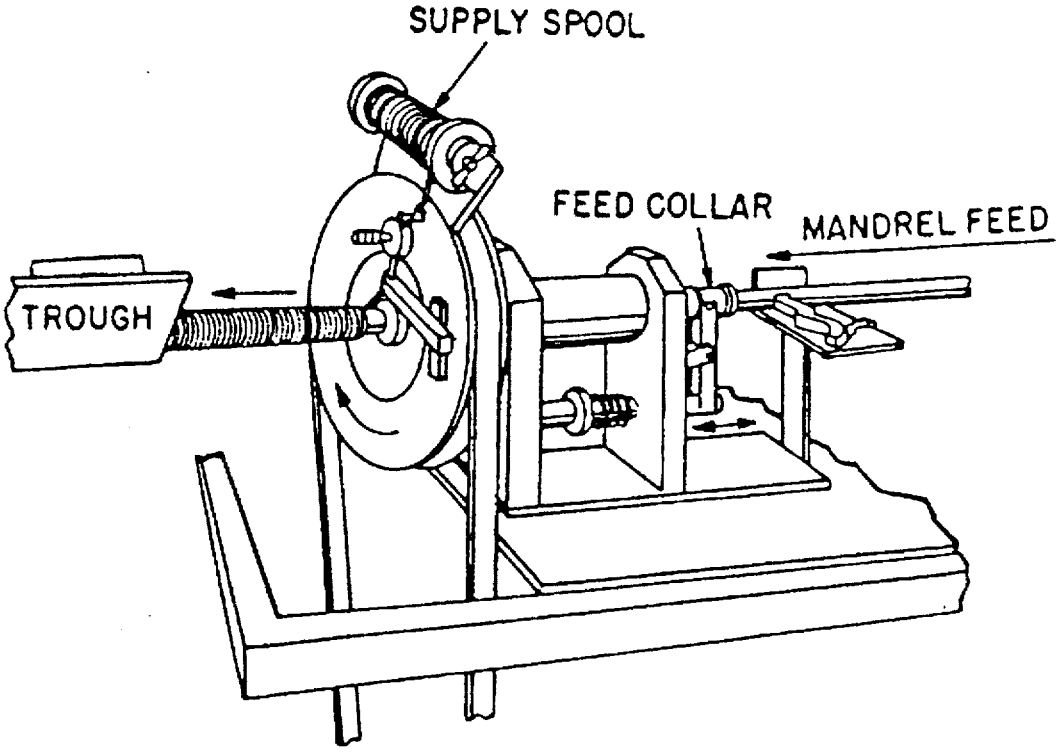

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *